United States Patent [19]

Carlson

[11] Patent Number: 5,047,143

[45] Date of Patent: Sep. 10, 1991

[54] METHOD FOR CONVERTING LOWER GRADE UINTAITE TO HIGHER GRADE MATERIALS

[75] Inventor: Robert M. Carlson, Irvine, Calif.

[73] Assignee: Chevron Research Company, San Francisco, Calif.

[21] Appl. No.: 323,034

[22] Filed: Mar. 10, 1989

Related U.S. Application Data

[63] Continuation of Ser. No. 47,846, May 8, 1987, abandoned.

[51] Int. Cl.[5] ..... C10G 1/04

[52] U.S. Cl. ..... 208/428; 208/400; 208/429; 208/434

[58] Field of Search ..... 208/314, 428, 429, 434, 208/435, 415, 177, 251 R, 309, 321, 337, 336, 322, 80

[56] References Cited

U.S. PATENT DOCUMENTS

| | | | |
|---|---|---|---|
| 2,775,292 | 11/1973 | Watkins | 208/80 X |
| 3,558,408 | 1/1971 | Wise | 208/429 X |
| 3,791,956 | 2/1974 | Gorin et al. | 208/415 X |
| 3,929,193 | 12/1975 | Duke | 208/428 |
| 4,164,466 | 8/1979 | Baldwin et al. | 208/435 |
| 4,312,747 | 11/1982 | Gatsis | 208/435 X |
| 4,374,015 | 2/1983 | Brulé | 208/415 |
| 4,539,093 | 9/1985 | Friedman et al. | 208/429 X |
| 4,548,701 | 10/1985 | Wolff | 208/435 X |

OTHER PUBLICATIONS

"Kirk-Othmer Encyclopedia of Chemical Technology," 3rd ed.; vol. 11, 1980, pp. 802-805.

*Primary Examiner*—Anthony McFarlane

*Attorney, Agent, or Firm*—Witta Priester; Edward J. Keeling

[57] ABSTRACT

I disclose a method for upgrading low-grade uintaite to high-grade uintaite having a desired meltpoint. It comprises dissolving the uintaite in a medium polarity solvent, mixing the dissolved uintaite with a nonpolar saturated hydrocarbon solvent at a volume-to-volume ratio that determines the meltpoint of the upgraded uintaite product, separating residual asphaltenes from the mixture, and recovering the medium polarity solvent and nonpolar saturated hydrocarbon to produce an upgraded uintaite having the desired meltpoint.

9 Claims, 3 Drawing Sheets

MELT POINT VS. SOLVENT RATIO

MELT POINT VS. WEIGHT % MALTENES

METHOD FOR CONVERTING LOWER GRADE UINTAITE TO HIGHER GRADE MATERIALS

This application is a continuation of application Ser. No. 47,846 filed May 8, 1987, now abandoned.

BACKGROUND OF THE INVENTION

This invention relates to a method for converting lower grade, high-melt-point uintaite into higher grade, lower-melt-point materials. The method comprises three steps. In the first step, low-grade, high-meltpoint uintaite is first dissolved in a medium polarity solvent and then blended with a nonpolar saturated hydrocarbon at a volume ratio that determines the meltpoint of the final upgraded uintaite product. In the second step, residual asphaltenes are removed from the solvent-uintaite mixture. In the third step, the solvent is separated from the asphaltene-free uintaite mixture and is recycled to produce an upgraded uintaite having a desirable meltpoint.

In particular, I have found that the proportion of nonpolar saturated hydrocarbon to uintaite solution determines the amount of asphaltenes removed and therefore the meltpoint of the resulting product. When I used a 20:1 volume ratio, all of the asphaltenes were removed resulting in a uintaite which has a meltpoint nearly 100° F. below the highest grade of naturally occurring uintaite.

Uintaite is a kind of natural asphalt mined in Utah and Colorado in the United States and obtained as dark and brilliant solid in a fairly pure state. Uintaite is thought to be a thermally immature lacustrine petroleum derived from Green River shale source rock by a natural expulsion process. Uintaite has a penetration of 0-1 and a softening point of about 140° C.; also, its hardness is very high. It has extremely low adhesiveness so that it can be readily pulverized into non-sticky particles. Moreover, uintaite is highly miscible or compatible with other asphalts, paint solvents, etc., and has high weather-resistance.

Researchers in the field have disclosed many methods for extracting various fractions from bituminous materials. The most well known of these is "propane extraction" in which asphaltic materials are extracted from heavy hydrocarbons by a single solvent extraction step using propane: For example, U.S. Pat. No. 2,726,192 to Kieras discloses extracting propane precipitated asphalts with n-butanol in the range of 20:1. Kieras teaches that the temperature of the extract is progressively lowered to produce the desired resin fractions.

U.S. Pat. No. 2,940,920 discloses that solvents other than propane can be used to separate heavy hydrocarbon materials into at least two fractions at a greatly improved rate of separation and in a manner which eliminates certain prior art operating difficulties encountered in the use of propane type solvents ($C_2$ to $C_4$ hydrocarbon solvents). That patent discloses effecting the separation by using high temperature-pressure techniques and by using pentane as one of a group of suitable solvents. Such practice permits a deeper cut to be made in the heavy hydrocarbon material, but as a consequence, more resinous bodies are present in the resulting oil fraction, tending to decrease the quality of that oil.

U.S. Pat. No. 3,830,732 discloses a two-solvent extraction process for producing three fractions from a hydrocarbon charge stock containing asphaltenes, resins and oils. The charge stock is admixed with a first solvent in a volumetric ratio of solvent to charge stock of less than about 4:1 to form a mixture that is introduced into a first extraction zone maintained at an elevated temperature and pressure. The mixture separates within the first extraction zone to produce a first solvent-rich liquid phase containing oils which are free of asphaltenes and resins and a first solvent-lean liquid phase containing asphaltenes and resins. The solvent-lean liquid phase then is contacted with a second solvent containing at least one more carbon atom per molecule than the first solvent and introduced into a second extraction zone. The second extraction zone is maintained at a lower temperature and pressure than the first extraction zone to separate the solvent-lean liquid phase into a second solvent-rich liquid phase containing resins and a second solvent-lean liquid phase containing asphaltenes.

U.S. Pat. No. 3,775,292 discloses a similar process employing a two-stage solvent extraction. There, the solvent-rich fraction which contains resins and oils is admixed with additional solvent and introduced into a second extraction zone maintained at a temperature higher than in the first extraction zone. The solvent-rich phase is separated into a second solvent-rich phase comprising oils and a second solvent-lean fraction comprising resins.

It would be desirable to provide a method in which solvent extraction can be used to convert low-grade uintaite into high-grade uintaite. Accordingly, it is the principle object of this invention to provide such a method.

SUMMARY OF THE INVENTION

The invention concerns a method for upgrading low-grade uintaite to high-grade uintaite to produce a desired meltpoint of the upgraded uintaite. It comprises: (a) dissolving the uintaite in a medium polarity solvent; (b) mixing the product of step (a) with a nonpolar saturated hydrocarbon solvent at a volume ratio of dissolved uintaite to nonpolar saturated hydrocarbon solvent to produce the desired meltpoint; (c) separating residual asphaltenes from the product of step (b); and (d) heating the product of step (c) to recover said medium polar solvent and said nonpolar saturated hydrocarbon solvent to produce an upgraded uintaite product having a desirable melting point.

In a preferred embodiment, the method for upgrading low-grade uintaite to high-grade uintaite of a desired meltpoint comprises: (a) dissolving the uintaite in a medium polarity solvent comprising methylene chloride; (b) mixing the product of step (a) with a nonpolar saturated hydrocarbon solvent comprising hexane, wherein said solvent is present in a ratio of about 20:1; (c) separating residual asphaltenes from the product of step (b); (d) treating the product of step (c) to recover said medium polar solvent and said nonpolar saturated hydrocarbon solvent to produce a solid maltene fraction; and (e) dissolving the maltene fraction of step (d) in a medium polarity solvent comprising methylene chloride with a lower grade uintaite or a fraction of asphaltene, recovered in step (c), in a ratio to produce a uintaite product having the desired meltpoint.

DETAILED DESCRIPTION OF THE INVENTION

Figure 1:
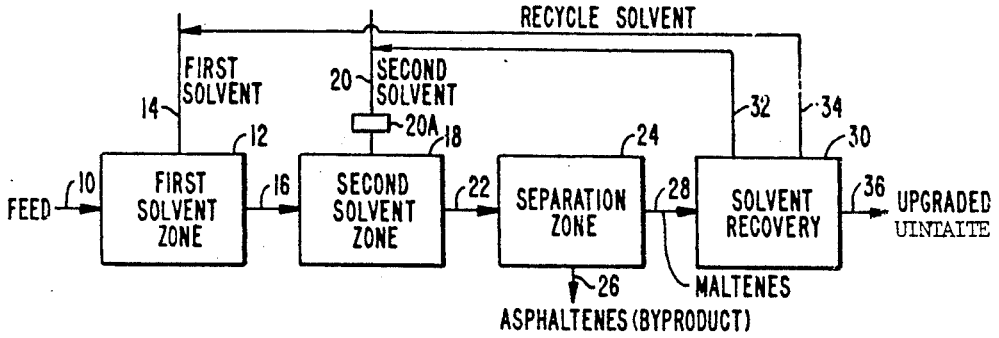
FIG. 1 is a diagrammatic illustration of the process of this invention.

Turning now to FIG. 1, the method of the present invention is illustrated. A feedstock comprising a low-grade uintaite is introduced into a first solvent zone 12 through a conduit 10. A medium polarity solvent is introduced into first solvent zone 12 through a conduit 14 to contact and dissolve the feed to provide a mixture. The medium polarity solvent has a high enough boiling point so that it easily separates from the low-boiling saturated hydrocarbon solvent used in the second solvent zone, but has a low enough boiling point, so as not to incur excessive energy costs during separation. It is generally selected from the group consisting of methylene chloride, benzene, toluene and refinery distillation cuts comprising benzene, toluene, or xylene. The most preferred solvent is a refinery distillation cut comprising benzene, toluene, or xylene. Sufficient solvent is introduced into first solvent zone 12 to thoroughly dissolve the feed. It is to be understood that larger quantities of solvent may be used, but such use is unnecessary.

The mixture is withdrawn from first solvent zone 12 and introduced into a second solvent zone 18 via a conduit 16. A saturated hydrocarbon solvent is introduced into the second solvent zone 18 through a conduit 20 to provide a ratio by volume of feed to saturated hydrocarbon solvent in the mixture in the range of from about 1:2 to about 1:20 and preferably in the range of from about 1:5 to about 1:10. The proportion of nonpolar saturated hydrocarbon solvent to uintaite solution determines the amount of asphaltenes removed and therefore, the meltpoint of the resulting product. It is controlled by proportioning valve 20A. A 1:20 ratio, or greater, removes all asphaltenes, resulting in the lowest meltpoint uintaite possible.

The saturated hydrocarbon solvent is a lowboiling normal paraffinic hydrocarbon which can be easily separated from the medium polarity solvent of the first solvent zone. It is generally selected from the group consisting of pentane, hexane, heptane and refinery distillation cuts comprising pentane, hexane and heptane. The most preferred solvent is a refinery distillation cut comprising pentane, hexane, or heptane.

The mixture is withdrawn from the second solvent zone 18 and introduced into the separation zone 24 via a conduit 22. The separation zone 24 is maintained at an elevated temperature and pressure to effect a separation of the mixture into a fluid-like light phase comprising maltenes and solvent and a solid particular slurry phase comprising asphaltenes and some solvent which exits the separation zone 24 through conduit 26.

The separated light phase is withdrawn from the separation zone 24 through a conduit 28 and introduced into the solvent recovery zone 30. The solvent recovery zone 30 is maintained at an elevated temperature and pressure to effect a separation of the light phase into second and third light phases. The order of solvent removal is determined by the relative boiling points of the saturated hydrocarbon and medium polarity solvent used. In general, the second light phase is lower boiling than the third light phase and comprises the saturated hydrocarbon solvent which is withdrawn from the solvent recovery zone 30 through a conduit 32 for recycle to the second solvent zone 18 to aid in the preparation of the mixture produce therein. The third light phase comprises the medium polar solvent which is withdrawn from the solvent recovery zone 30 through a conduit 34 for recycle to the first solvent zone 12 to aid in the preparation of the mixture produced therein.

The upgraded uintaite solid is withdrawn from the solvent recovery zone 30 through conduit 36 and recovered.

Figure 2:
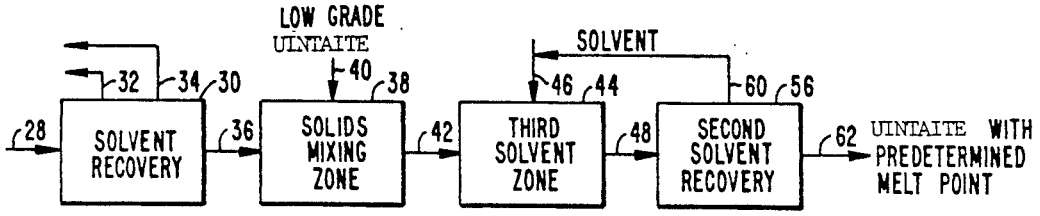
FIG. 2 is a diagrammatic illustration of the process of this invention depicting mixing solid maltene into dry lower grade uintaite to obtain an upgraded uintaite of a desired, predetermined meltpoint.

Turning now to FIG. 2 an alternate embodiment of the present invention is illustrated. In this embodiment, the weight proportion of low-grade uintaite to upgraded uintaite determines the meltpoint of the resulting product. The upgraded uintaite solid is introduced into a solids mixing zone 38 through conduit 36. A low-grade uintaite feed is introduced into the mixing zone 38 through conduit 40 to contact and admix with the upgraded uintaite to produce a homogeneous mixture.

The solid mixture is withdrawn from the mixing zone 38 through a conduit 42 and introduced into third solvent zone 44.

A medium polarity solvent is introduced into third solvent zone 44 through a conduit 46 to contact and dissolve the solid mixture. The medium polarity solvent is the same as in the first solvent zone. Sufficient solvent is introduced into third solvent zone 44 to thoroughly dissolve the feed. Larger quantities of solvent may be used, but such use is unnecessary.

The mixture is withdrawn from the third solvent zone 44 through a conduit 48 and introduced into the second solvent recovery zone 56. The second solvent recovery zone 56 is maintained at an elevated temperature and pressure to effect a separation of the mixture into two light streams and one heavy stream. The light streams are recovered through conduits 60 and is recycled to the third solvent zone to aid in the preparation of mixture produced therein.

The upgraded uintaite solid is withdrawn from the solvent recovery zone 56 through conduit 62 and recovered.

Figure 3:
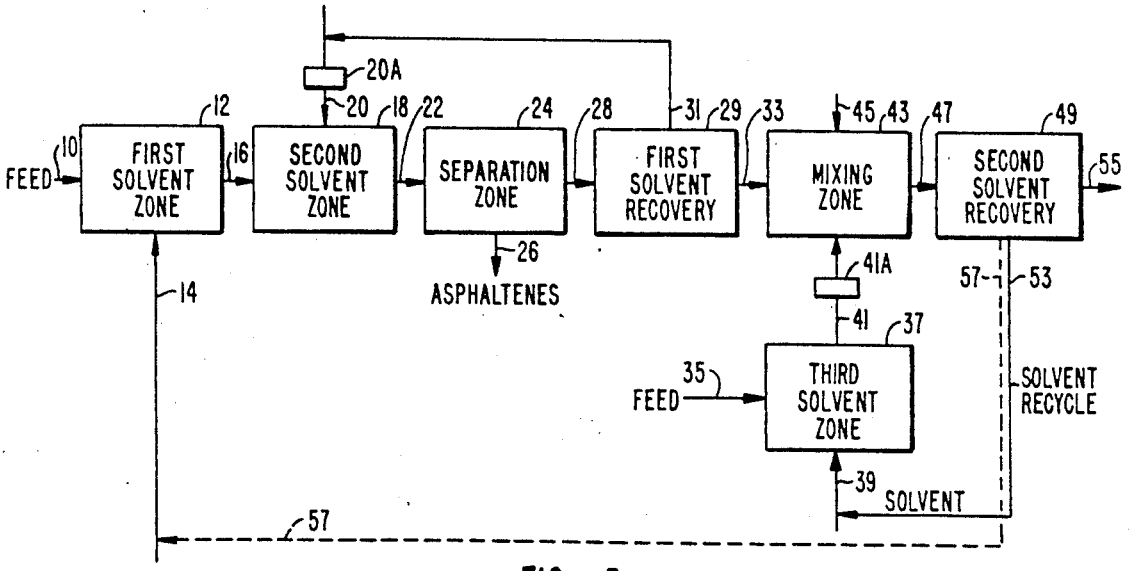
FIG. 3 is a diagrammatic illustration of the process of this invention depicting mixing dissolved maltene into dissolved lower grade uintaite.

Turning now to FIG. 3, a second alternative embodiment of the present invention is illustrated. In this embodiment, a feedstock comprising a low-grade uintaite is introduced into a first solvent zone 12 through a conduit 10. A medium polarity solvent comprising toluene is introduced into first solvent zone 12 through a conduit 14 to contact and dissolve the feed to provide a mixture. Sufficient solvent is introduced into first solvent zone 12 to thoroughly dissolve the feed. Larger quantities of solvent may be used, but such use is unnecessary.

The mixture is withdrawn from first solvent zone 12 and introduced into a second solvent zone 18 via a conduit 16. A saturated hydrocarbon solvent comprising pentane is introduced into the second solvent zone 18 through a conduit 20 to provide a ratio by volume of feed to saturated hydrocarbon solvent in the mixture in the range greater than 1:10 and preferably in the range of from about 1:15 to about 1:20. Larger quantities of solvent may be used but such use is unnecessary.

The mixture is withdrawn from the second solvent zone 18 and introduced into the separation zone 24 via a conduit 22. The separation zone 24 is maintained at an elevated temperature and pressure to effect a separation of the mixture into a fluid-like light phase comprising maltenes and solvent and a fluid-like heavy phase comprising asphaltenes and some solvent which exits the separation zone 24 through conduit 26.

The separated light phase is withdrawn from the separation zone 24 through a conduit 28 and introduced into the first solvent recovery zone 29. The first solvent recovery zone 29 is maintained at an elevated temperature and pressure to effect a separation of the saturated hydrocarbon solvent.

The saturated hydrocarbon solvent is withdrawn from the first solvent recovery zone 29 through a conduit 31 for recycle to the second solvent zone 18 to aid in the preparation of the mixture produced therein.

A feedstock comprising a low-grade uintaite is introduced into a third solvent zone 37 through a conduit 35. A medium polarity solvent, comprising toluene is introduced into the third solvent zone 37 through a conduit 39 to contact and dissolve the feed to provide a mixture. Sufficient solvent is introduce into the third solvent zone 37 to thoroughly dissolve the feed.

The dissolved uintaite from the first solvent recovery zone 29 is withdrawn via conduit 33 and introduced into mixing zone 43. The dissolved uintaite from the third solvent zone 37 is withdrawn via conduit 41 and introduced into mixing zone 43 where it is admixed with the dissolved uintaite from the first solvent recovery zone 29. By using proportioning valve 41A to control the ratio of upgraded uintaite to low-grade uintaite, the desired meltpoint of the final upgraded uintaite product can be achieved.

The mixture of dissolved uintaites is withdrawn from the mixing zone 43 and introduced into the second solvent recovery zone 49 via conduit 47. The second solvent recovery zone 49 is maintained at an elevated temperature and pressure to effect a separation into a light stream and a heavy stream. The light stream comprises the medium polar solvent which is withdrawn from the second solvent recovery zone 49 through a conduit 53 for recycle to the third solvent zone 37 to aid in the preparation of the mixture produced therein. Alternatively, the medium polarity solvent can be recycled to the first solvent zone 12 via conduit 57.

Figure 6:
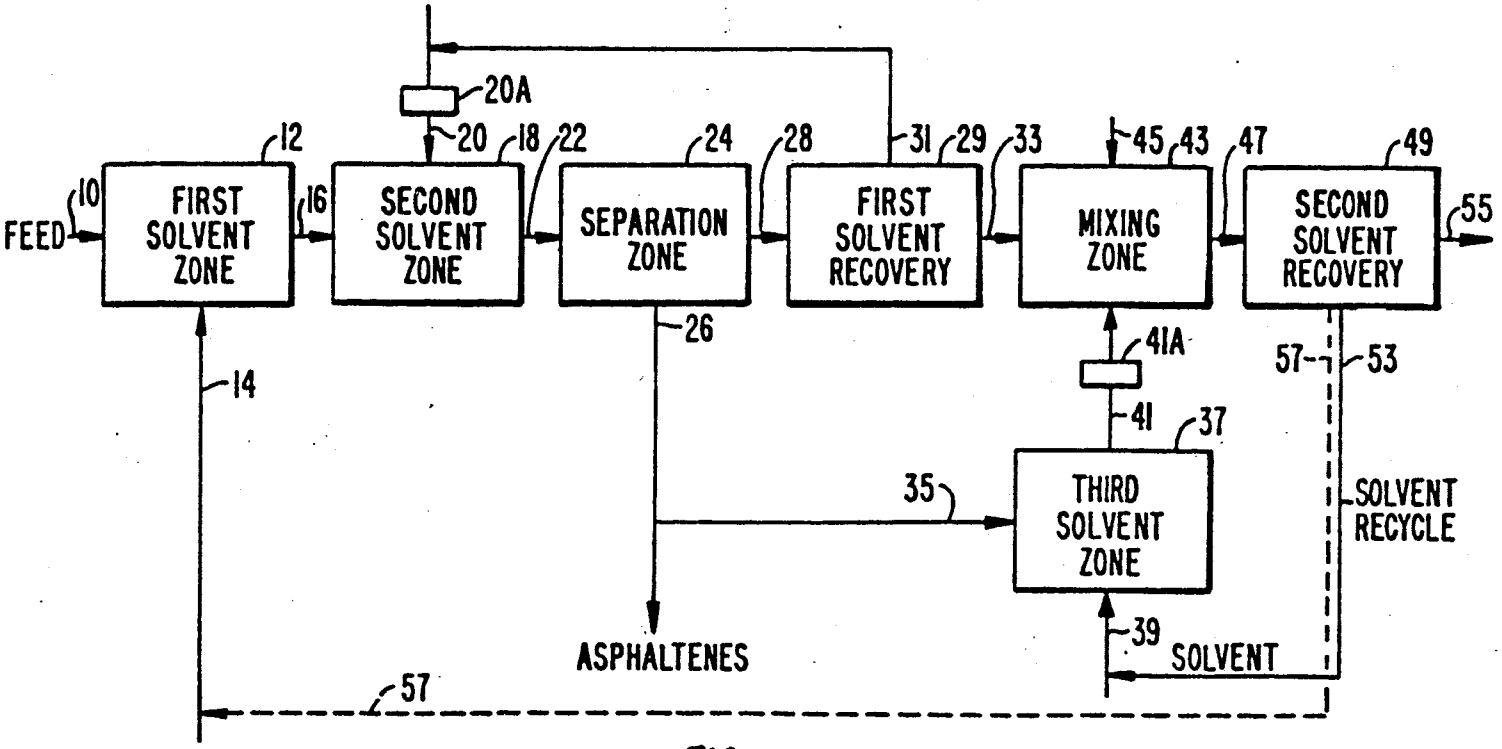
FIG. 6 is a diagrammatic illustration of the process of this invention depicting mixing dissolved maltene with dissolved asphaltene from the separation zone.

The upgraded uintaite solid is withdrawn from the solvent recovery zone 49 through conduit 55 and recovered. Turning now to FIG. 6, another alternative embodiment of the present invention is illustrated. This embodiment is similar to that disclosed in FIG. 3 except that a portion of the asphaltenes 26, from the separation zone 24, is the low grade uintaite feed (35) that is introduced into the third solvent zone 37.

To further illustrate the process of this invention and not by way of limitation, the following examples are provided.

EXAMPLES

Example 1

Figure 4:
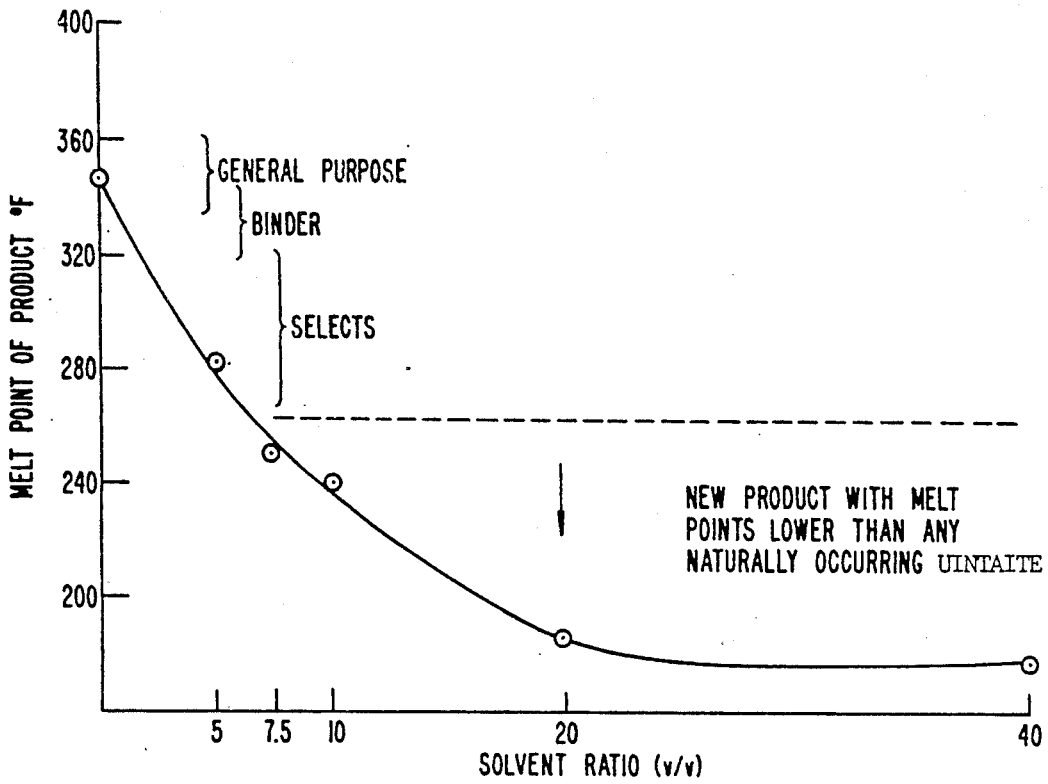
FIG. 4 is a plot depicting the relationship between the solvent ratio to the final meltpoint of the upgraded uintaite product.

A natural uintaite (Harrison Vein, CRC 42504-1) of meltpoint 346° F. (determined by ASTM No. E-28-67) was dissolved in a minimum volume of a medium polarity solvent (methylene chloride). This solution was then added to n-hexane at the various volume to volume ratios shown in FIG. 4. The heavy component enriched in uintaite asphaltenes was allowed to settle from each mixture and each upper liquid phase enriched in uintaite maltenes was decanted off. The solvents were removed from each upper liquid phase leaving a solid modified uintaite enriched in maltenes. The meltpoint of each modified uintaite was determined by ATM No. E-28-67 and the results plotted in FIG. 4 as a function of the n-hexane/uintaite solution volume to volume ratio used in the processing. FIG. 4 shows that as greater volume to volume ratios are used, lower meltpoint (higher grade) modified uintaites are produced. When solvent ratios greater than 7/1 are used, the resulting modified uintaite product has meltpoints lower than any natural uintaite. When solvent volume ratios of 20:1 are used, the lowest possible meltpoint (180° F.) product is obtained: higher solvent ratios did not lower product meltpoint further in this case. Moreover, FIG. 4 shows that by selecting a specific processing volume ratio, uintaite of a desired (predetermined) meltpoint can be obtained.

Example 2

Figure 5:
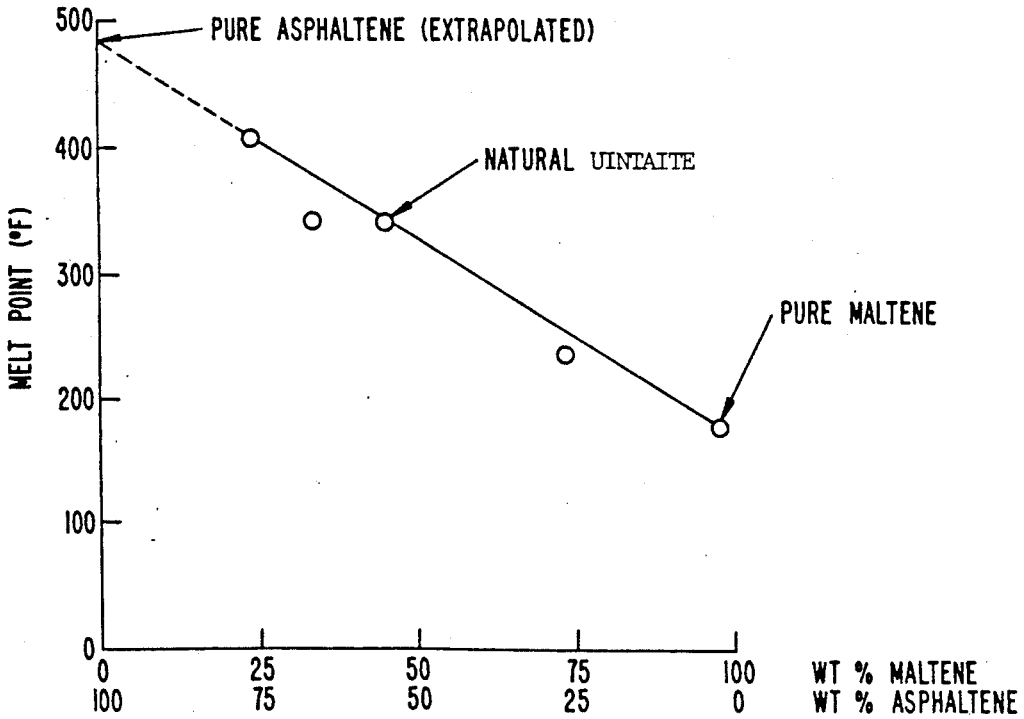
FIG. 5 is a plot depicting the relationship between the weight percent of maltenes to the meltpoint of the upgraded uintaite product.

Processed uintaite of meltpoint 180° F. (prepared as described in Example 1), referred to as uintaite maltenes below, was mixed with uintaite asphaltenes (recovered as a byproduct of the Example 1 process) in the various weight to weight ratios shown in FIG. 5. In this example, the uintaite asphaltenes are equivalent to a low-grade uintaite. The various asphaltene-processed uintaite mixtures were each thoroughly dissolved in a minimum volume of toluene. The toluene was then removed under reduced pressure and the meltpoint of the resulting solid product was measured using ASTM No. E-28-67. FIG. 5 shows that at the weight proportion of maltene to asphaltene is increased a product of improved, lower meltpoint is obtained. FIG. 5 shows that by choosing specific weight to weight ratios, uintaite products of a desired (predetermined) meltpoint can be prepared. Moreover, this process could be used to improve meltpoint characteristics of stocks of lower grade uintaite materials.

The foregoing examples illustrate the effectiveness of the present invention in reducing the melting point of uintaite and therefore producing an upgraded uintaite product.

While the invention has been described with respect to what at present are preferred embodiments thereof, it will be understood, of course, that certain changes, substitutions, modifications and the like may be made therein without departing from its true scope as defined in the appended claims.

What is claimed is:

1. A method for upgrading uintaite to produce an upgraded uintaite product, comprising:

(a) dissolving uintaite feed in a medium polarity solvent to produce a first mixture;

(b) mixing said first mixture with a nonpolar saturated hydrocarbon solvent at a volume ratio of said first mixture to said nonpolar saturated hydrocarbon solvent to produce a second mixture comprising alight phase and a solid phase;

(c) separating said solid phase containing residual asphaltenes from said second mixture to produce a light phase product; and (d) heating the light phase product of step (c) to recover said medium polarity solvent and said nonpolar saturated hydrocarbon solvent to produce an upgraded uintaite product having a lower meltpoint than the starting uintaite;

wherein the relative proportion of said medium polarity solvent containing dissolved uintaite feed and said nonpolar solvent in said second mixture of step (b) is selected so that the meltpoint of said upgraded uintaite product of step (d) is about 30° C. to about 170° F. lower than the meltpoint of the unitaite feed.

2. A method, according to claim 1, further comprising:

(e) dissolving the product of step (d) and a fraction of said solid phase recovered instep (c) in a medium polarity solvent in a weight ratio to produce a second uintaite product.

3. A method, according to claim 1, further comprising:

(f) mixing the product of step (d) with a uintaite feed;

(g) dissolving the uintaite mixture of step (f) in a medium polarity solvent; and (h) heating the mixture of step (g) to recover said medium polarity solvent to produce a second uintaite product.

4. A method, according to claim 1, 2, or 3, wherein said nonpolar saturated hydrocarbon solvent is selected from the group consisting of pentane, hexane and heptane.

5. A method, according to claim 1, wherein said nonpolar saturated hydrocarbon solvent is present in a ratio of at least 5 to 1 hydrocarbon solvent to medium polarity solvent containing dissolved uintaite feed.

6. A method, according to claim 5, wherein said ratio is at least 10 to 1.

7. A method, according to claim 6, wherein said ratio is at least 20 to 1.

8. A method for upgrading uintaite, comprising:

(a) dissolving uintaite feed in a refinery distillation cut comprising an aromatic hydrocarbon selected from the group consisting of benzene, toluene an xylene to produce a uintaite solution;

(b) mixing the solution of step (a) with a nonpolar saturated hydrocarbon solvent comprising hexane, wherein said solvent is present in a ratio of about 20:1 solvent to solution to produce a mixture;

(c) separating residual solid asphaltenes form the mixture of step (b) to produce a light phase;

(d) heating the light phase of step (c) to recover said refinery distillation cut and said nonpolar saturated hydrocarbon solvent to produce a solid maltene fraction having a meltpoint of about 30° to 170° F. lower than the meltpoint of said uintaite feed, and (e) dissolving the maltene fraction of step (d) and a fraction of said asphaltenes recovered in step (c) in a medium polarity solvent to produce a uintaite product.

9. A method for upgrading uintaite, comprising:

(a) dissolving uintaite feed in a medium polarity solvent comprising toluene to produce a solution;

(b) mixing the solution of step (a) with a nonpolar saturated hydrocarbon solvent;

(c) separating residual asphaltenes from the product of step (b) to produce a light phase;

(d) dissolving a feed uintaite in a medium polarity solvent comprising toluene;

(e) mixing the light phase of step (c) with the solution of step (d) at a volume ratio of said light phase to said dissolved feed uintaite to produce a uintaite mixture;

(f) heating the mixture of step (e) to recover said medium polarity solvent and said nonpolar saturated hydrocarbon solvent to produce an ungraded uintaite product having a meltpoint of about 30° to 170° F. lower than the meltpoint of said uintaite feed.

* * * * *

UNITED STATES PATENT AND TRADEMARK OFFICE

CERTIFICATE OF CORRECTION

PATENT NO. : 5,047,143

DATED : September 10, 1991

INVENTOR(S) : Robert M. Carlson

It is certified that error appears in the above-identified patent and that said Letters Patent is hereby corrected as shown below:

Claim 1, column 7, line 2, delete "alight" and insert --a light--.
column 7, line 10, after "uintaite;" insert --and--.
column 7, line 15, delete "C.".
Claim 2, column 7, line 21, delete "instep (c)" and insert --in step (c),--.
Claim 8, column 8, line 6, delete "an" and insert --and--.
column 8, line 12, delete "form" and insert --from--.

Signed and Sealed this

Ninth Day of March, 1993

*Attest:*

STEPHEN G. KUNIN

*Attesting Officer*

*Acting Commissioner of Patents and Trademarks*